US005921822A

United States Patent [19]

Kennedy et al.

[11] Patent Number: 5,921,822

[45] **Date of Patent: *Jul. 13, 1999**

[54] CONNECTOR ASSEMBLY

[75] Inventors: Robert D. Kennedy, deceased, late of Northville, Mich., by Donna Kennedy, legal representative; Robert G. Plyler, Vienna, Ohio

[73] Assignee: Framatome Connectors Interlock Inc., Westland, Mich.

[ * ] Notice: This patent issued on a continued prosecution application filed under 37 CFR 1.53(d), and is subject to the twenty year patent term provisions of 35 U.S.C. 154(a)(2).

[21] Appl. No.: 08/775,548

[22] Filed: Dec. 31, 1996

Related U.S. Application Data

[62] Division of application No. 08/686,317, Jul. 25, 1996

[60] Provisional application No. 60/001,429, Jul. 25, 1995.

[51] Int. Cl.[6] ..... H01R 11/22

[52] U.S. Cl. ..... 439/851

[58] Field of Search ..... 439/843, 846, 439/851, 848

[56] References Cited

U.S. PATENT DOCUMENTS

| | | | |
|---|---|---|---|
| 1,833,145 | 11/1931 | Wilhelm . | |
| 3,107,966 | 10/1963 | Bonhomme . | |
| 3,314,044 | 4/1967 | Powell | 439/851 |
| 3,641,483 | 2/1972 | Bonhomme | 439/851 |
| 3,704,441 | 11/1972 | Douglass | 439/843 |
| 3,815,081 | 6/1974 | Jones | 439/851 |
| 4,128,293 | 12/1978 | Paoli | 439/843 |
| 4,203,647 | 5/1980 | Bonhomme | 439/851 |
| 4,447,108 | 5/1984 | Ghigliotti et al. | 439/851 |
| 4,486,068 | 12/1984 | Ghigliotti et al. . | |
| 4,550,972 | 11/1985 | Romak | 439/851 |
| 4,720,157 | 1/1988 | Nestor et al. | 439/851 |
| 4,746,306 | 5/1988 | Yurtin et al. | 439/357 |
| 4,750,897 | 6/1988 | Neidecker | 439/825 |
| 4,840,587 | 6/1989 | Lancella | 439/851 |
| 4,840,588 | 6/1989 | Lancella | 439/851 |
| 4,950,179 | 8/1990 | Takenouchi et al. | 439/352 |
| 4,993,967 | 2/1991 | Matsumoto | 439/489 |
| 5,026,298 | 6/1991 | Brussalis et al. | 439/358 |
| 5,083,927 | 1/1992 | Herard et al. | 439/80 |
| 5,127,847 | 7/1992 | Kato et al. | 439/489 |
| 5,167,543 | 12/1992 | Wurster | 439/851 |
| 5,199,910 | 4/1993 | Kahle et al. | 439/843 |
| 5,236,373 | 8/1993 | Kennedy | 439/347 |
| 5,257,944 | 11/1993 | Kennedy | 439/347 |
| 5,326,289 | 7/1994 | Leisey | 439/851 |

FOREIGN PATENT DOCUMENTS

| | | |
|---|---|---|
| 2378377 | 8/1978 | France . |
| 1565973 | 3/1970 | Germany . |
| 8804092 | 8/1988 | Germany . |

*Primary Examiner*—Paula Bradley
*Assistant Examiner*—Tho Dac Ta
*Attorney, Agent, or Firm*—Perman & Green, LLP

[57] ABSTRACT

A connector assembly having a male connector body engagable with a female connector body. At least one female terminal is mounted in one of the connector bodies and the terminal includes a contact portion having a generally cylindrical shape with opposing ends and a plurality of contact beams extending between the ends to define a reduced effective diameter located between the ends. The assembly also includes a preassembled terminal position assurance mechanism, which for providing an indicia of whether the terminal is fully seated within the connector body, and a preassembled connector position assurance mechanism, which provides an indicia of whether the connector bodies are fully engaged with one another.

13 Claims, 8 Drawing Sheets

CONNECTOR ASSEMBLY

REFERENCE TO RELATED APPLICATION

This is a division of U.S. patent application Ser. No. 08/686,317, filed Jul. 25, 1996 still pending, which claims the benefit of provisional application Ser. No. 60/001,429, filed Jul. 25, 1995.

BACKGROUND AND SUMMARY OF THE INVENTION

1. Field of the Invention

The present invention relates generally to connector assemblies that house electrical terminals. More specifically, this invention relates to a sealed connector assembly which incorporates a connector position assurance member, a terminal position assurance member and an electrical terminal with oblique contact springs.

2. Description of the Prior Art

With present day sealed connector assemblies, as used in automobiles and other vehicles, several types of problems often coexist. One problem involves the engagement of the connectors themselves. Because of their sealed nature, it is often difficult to determine if the male and female connectors are fully engaged with one another. Connector position assurance (hereinafter "CPA") members have been devised to provide a positive indication of whether the connectors have been fully engaged with one another. Most often, the CPA member is provided either as a separate, post engagement part or as a separate part which is mounted to one of the connectors in a preassembled position. With the former, the CPA member is mountable to one of the connectors only after they have been fully engaged with one another. In the latter type, the CPA member is movable from a preassembled position into a fully assembled position only after the connectors have become fully engaged with one another.

Another often seen problem with connector assemblies is that it is difficult to determine if the terminals themselves have been fully seated within the connector housings. Terminal position assurance (hereinafter "TPA") members have been devised to address this problem. In one variety, the TPA member is in the form of a wedge premounted to the front or mating end of the connector. The TPA wedge pushes the terminals backward, in the direction opposite of terminal engagement, in order to fully seat them with respect to the remainder of the connector housing and then snaps into place. Another type of TPA member is provided as an insertable comb. The comb can only be installed after the terminals have been fully inserted into the connector body and, typically, the comb engages a rearward shoulder of the terminal to interferingly prevent withdrawal of the terminals from the housing.

Finally, problems are also encountered because of a failure in the male and female contact terminals to adequately engage. Failure to do so results in less than maximum electrical conduction. In previous constructions, terminal designs have also required significant insertion forces (relative to contact forces), have exhibited asymmetrical biasing of the spring elements, and have exhibited asymmetrical conduction. The latter can result in the formation of hot spots within the terminal resulting in premature fatigue, failure and other problems.

In view of the foregoing limitations and shortcomings of the prior art devices, as well as other disadvantages not specifically mentioned above, it should be apparent that there still exists a needed in the art for an improved sealed connector assembly including the features of a CPA member, a TPA member and improved contact terminals.

It is therefore a primary object of this invention to fulfill that need by providing a sealed connector assembly having an improved terminal design, a terminal position assurance feature and a connector position assurance feature.

A related object of this invention to provide an improved terminal design in which a contact configuration of the spring elements in the female terminal is symmetrical about the male terminal.

Still another object of the present invention is to provide a terminal design in which a reduced insertion effort is required as a result of the configuration of the contact springs.

Also another object of the present invention is to provide an improved terminal design in which electrical contact is centered within the terminal to create a uniform electrical current distribution within the terminal.

It is also an object of this invention to provide a terminal construction where the contact springs of the terminal define a reduced diameter in the terminal, are properly positioned without a special manufacturing step, and are unitarily formed with the remainder of the terminal.

An additional object of this invention is to provide a sealed connector assembly having a TPA member preassembled with the connector housing prior to insertion of the terminals into the housing and which does not interfere with insertion of the terminals into the connector body.

Yet another object of the present invention is to provide a TPA member which forces unseated terminals forward, in the mating direction of the connectors, toward the front end of the connector body to fully seat the terminals within the connector body.

A further object of this invention is to provide a TPA member which engages only the elastomeric seal portion of the terminal providing the terminal with a predetermined amount of "float" during mating with another terminal.

Still another object of this invention is to provide a connector assembly having a CPA member which is preassembled with the connector body.

It is also an object of this invention is to provide a CPA member that transmits forces in the mating direction of assembly during engagement of the CPA member.

A further object of this invention is to provide a CPA member which positively identifies that the connectors are engaged, positively locks the connectors together, yet readily allows for intentional disengagement of the connector assembly.

SUMMARY OF THE INVENTION

Briefly described, these and other objects are accomplished according to the present invention by providing a sealed connector assembly with an improved terminal design, a preassembled TPA member that operates in the direction of engagement to positively seat the terminals and a preassembled CPA member that also operates in the direction of engagement to ensure the connectors are fully engaged with one another.

In the connector assembly of the present invention, male and female connector bodies house male and female terminals of which the male terminal is a pin-type terminal and the female terminal is a socket-type terminal. The female terminal is unitarily formed as a stamping from a blank of sheet metal stock and includes oblique contact springs or beams. The blank includes a series of generally parallel beams which extend obliquely or diagonally between a pair of end strips. By folding the end strips to form an otherwise cylindrical type of structure, the contact beams are automatically caused to extend obliquely from one end of the terminal to another. Because of the original oblique orientation of the beams, once the terminal has been formed into its final form, the beams will define and provide the terminal with an effectively reduced diameter located in the longitudinal center of the beams and the terminal. As further discussed below, this design provides for numerous mechanical and electrical advantages including requiring a lower terminal mating force, increasing surface contact and eliminating hot spots in the terminals. Additionally, the terminals are further supported by elastomeric cable seals which allow the terminals to slightly move or "float" with the connector body during mating. This in turn allows the mating terminals to self align.

Another feature of the present invention is that a TPA member is provided so as to be preassembled and secured to the connector body prior to insertion of the terminals into the connector body. The TPA member is retained on the rearward or terminal insertion end of the connector body by engagement between a flexible lock arm having locking ramps (on the TPA member) and a lock housing (on the connector housing). A set of lock ramps on the lock arm holds and retains the TPA member in its preassembled position while a set of lock bosses holds the TPA member in pits final, fully assembled position.

In positioning the terminals within the connector housing, the rearmost portion of the terminal assemblies, formed by the seal on the terminal assemblies, slides past what is herein referred to as a "stuffer". Notably, the stuffer of the TPA member does not interfere with and need not engage the terminals during their initial insertion into the connector body. Once the terminal has been inserted into the connector body, the TPA member is moved into its final assembly position. To do this, the operator must then manually flex the lock arms to release the TPA member from its preassembled position and allow it to be moved into its assembled position. With the stuffer located behind the terminal, the TPA member is moved forward. During movement of the TPA member into its assembled position, angled ribs, formed on the interior of the connector body, cause the stuffer to be deflected radially inward into a position directly behind the cable seals on the terminal. Further movement of the TPA member causes the stuffer to drive the cable seals forward against the forward stops in the connector body cavity, forcing the terminals into their fully seated positions. The TPA member is then "locked" in place by the lock bosses engaging the lock housing and the stuffer rests directly behind the cable seals of the terminals to assure that the terminals remain completely seated.

The CPA member of the present assembly is generally a sliding member which is preassembled onto a deflectable lock arm located on the top of the female connector body. The CPA member itself includes two upwardly extending actuating portions on opposing sides of the lock arm and these are interconnected by a transverse lower portion extending beneath the lock arm.

The CPA member is slid rearward (toward the fixed end of the lock arm) to a point where a shoulder, formed on the transverse portion of the CPA member, engages an undercut formed in the connector body. At this location the CPA member is held in its preassembled position by the resiliency of the lock arm which forces the engagement between the CPA shoulder, the undercut in the connector body and ribs formed on the underside of the lock arm.

As the male and female connectors are assembled together, the lock arm is first deflected toward the connector body further trapping the CPA member in its preassembled position. Any axial force applied to the CPA member at this point of engagement between the connector housings only causes the male and female connectors to further engage one another since the CPA member will not move relative to the female connector due to the continued engagement between the shoulder and undercut. Once the connectors have been completely engaged with one another, the ramping surfaces on the lock arm and on the housing pass beyond one another and the inherent biasing of the lock arm causes locking surfaces of the lock arm to engage locking surfaces on the lock housing. Once engaged in this position, an undercut release ramp formed on the male connector will have been advanced to a position where it provides for a ramp surface extending beyond the undercut. The ramp allows the CPA member to slide up the ramp and over the undercut. This axial movement of the CPA member up the lock release ramp and in the direction of engagement of the connectors result in the free end of the locking arm being biased into engagement with the locking housing on the male connector.

Continued forward movement causes the CPA member to become wedged beneath the free end of the lock arm. In this manner, the CPA member prevents the lock arm from deflecting inward or toward the housing thereby ensuring that the lock arm remains engaged with the corresponding surfaces on the male connector. Accordingly, only after complete and full engagement between the connectors has occurred can the CPA member be moved out of its preassembled position and, in this way, the CPA member assures that the connectors are fully engaged.

Additional benefits and advantages of the present invention will become apparent to those skilled in the art to which the present invention relates from the subsequent description of the preferred embodiment and the appended claims, taken in conjunction with the accompanying drawings.

DETAILED DESCRIPTION OF THE PREFERRED EMBODIMENT

Figure 1:
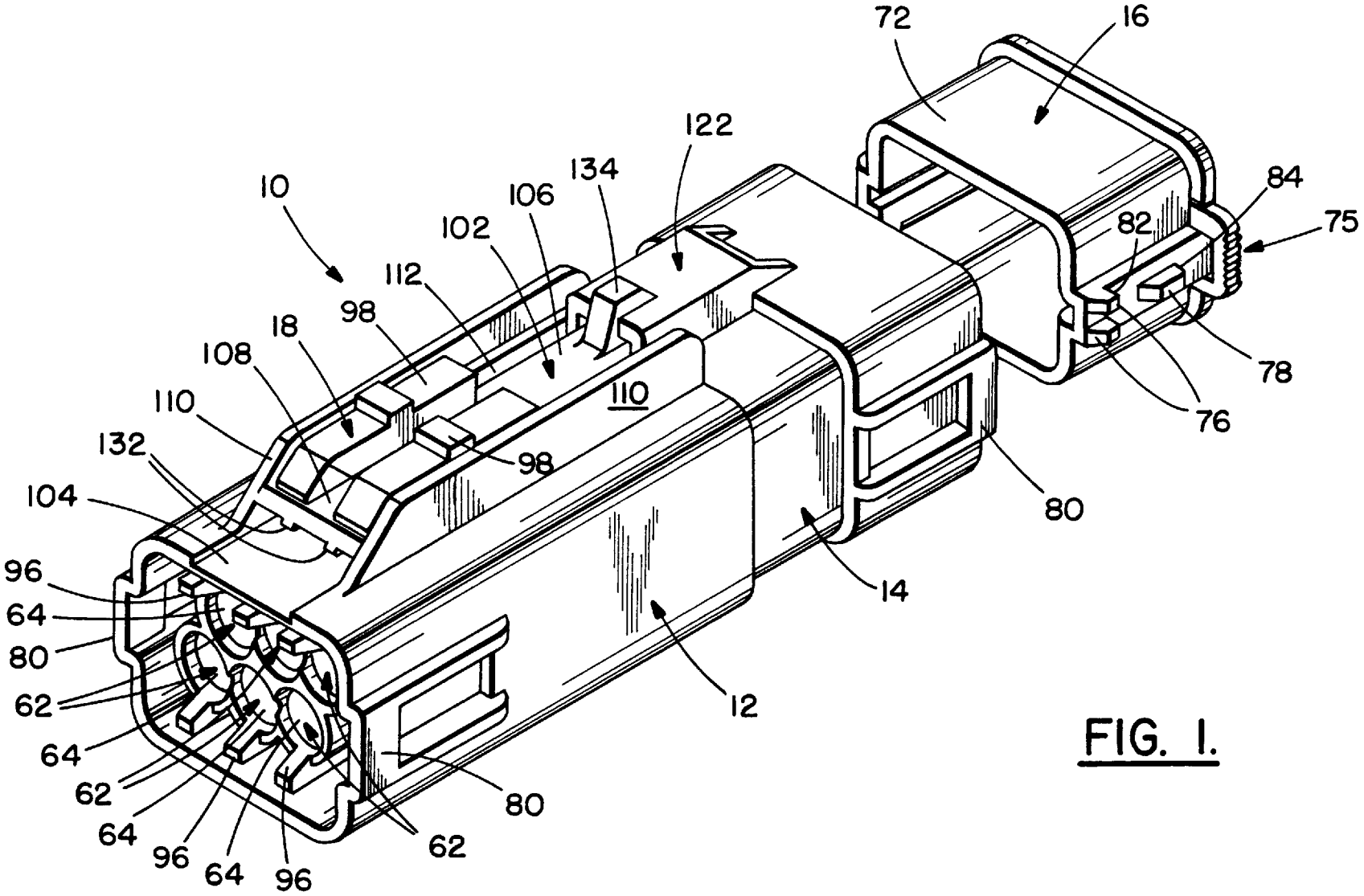
FIG. 1 is a perspective illustration of a connector assembly embodying the principles of the present invention omitting the terminals and associated electrical wires.

Referring now in detail to the drawings, a connector assembly embodying the principles of the present invention is shown in FIG. 1 and generally designated at 10. Generally, the assembly 10 is seen to include a female connector body 12, a male connector body 14, a pair of TPA members 16 (only one of which is seen in FIG. 1) and CPA member 18. In addition to the above, the assembly 10 also includes male and female terminals 20 and 22 which are more fully illustrated in the additional figures.

Referring now to FIGS. 3–8, the female terminal 22 will be described in greater detail. At one end, the female terminal 22 includes a wire crimping portion 24 and a seal crimping portion 26. The crimping portions 24 and 26 are generally tab-like formations which are respectively bent or "crimped" to engage a wire 28 and polyurethane or rubber seal 30.

Unitarily formed with and located forward of the wire crimping portion 24 is the contact portion 32 of the terminal 22. When fully formed, the contact portion 32 is seen to generally exhibit a cylindrical shape having generally hexagonal or similarly shaped front and rear end ferrules 38. Positioned over the contact portion 32 is a protective hood 34. The hood 34 does not contribute to the electrical capabilities of the terminal 22. Rather, it prevents inadvertent damage to a series of contact beams or springs 36 which extend obliquely between the end ferrules 38. To retain the hood 34 on the contact portion 32, the hood 34 includes a stake 40 which is bent to be received in a retention hole 42 of the rearward end ferrule 38.

Figure 8:
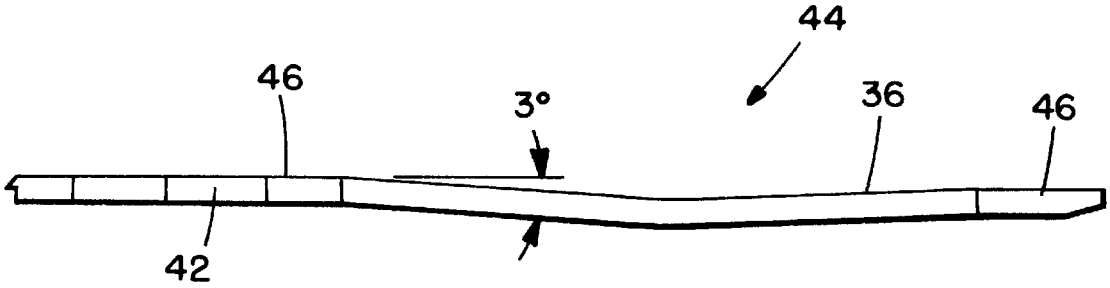
FIG. 8 is a partial side elevational view of the stamping seen in FIG. 7.

In forming the female terminal 22, a stamping 44 (shown in FIG. 7) is stamped out of a blank of sheet metal stock. In what will form the contact portion 32 of the terminal 22, the stamping 44 includes the series of beams 36 and these are seen as extending parallel to one another, obliquely or diagonally between a pair of end strips 46. Preferably, the center of the beams 36 are formed (as seen in FIG. 8) to exhibit a bend of approximately three degrees in the center thereof. A greater or lesser bend could be utilized if so desired to prevent a preload to the beams 36.

Figure 3:
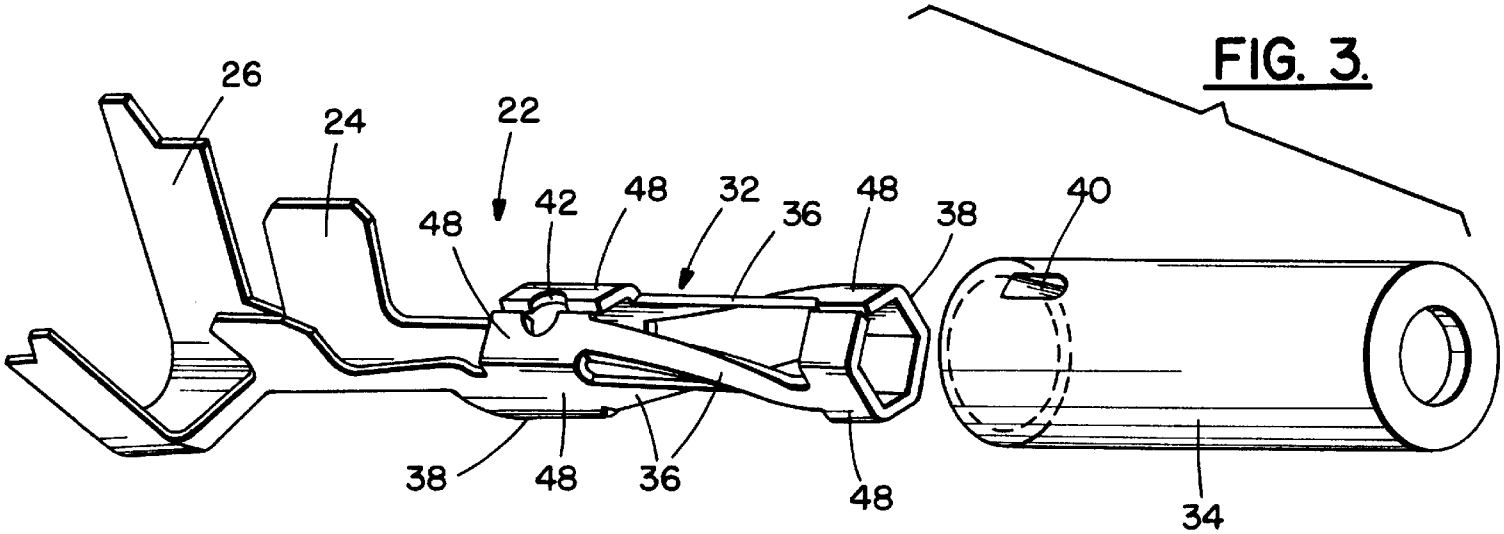
FIG. 3 is an exploded perspective view of a female contact terminal according to one aspect of the present invention.
Figure 4:
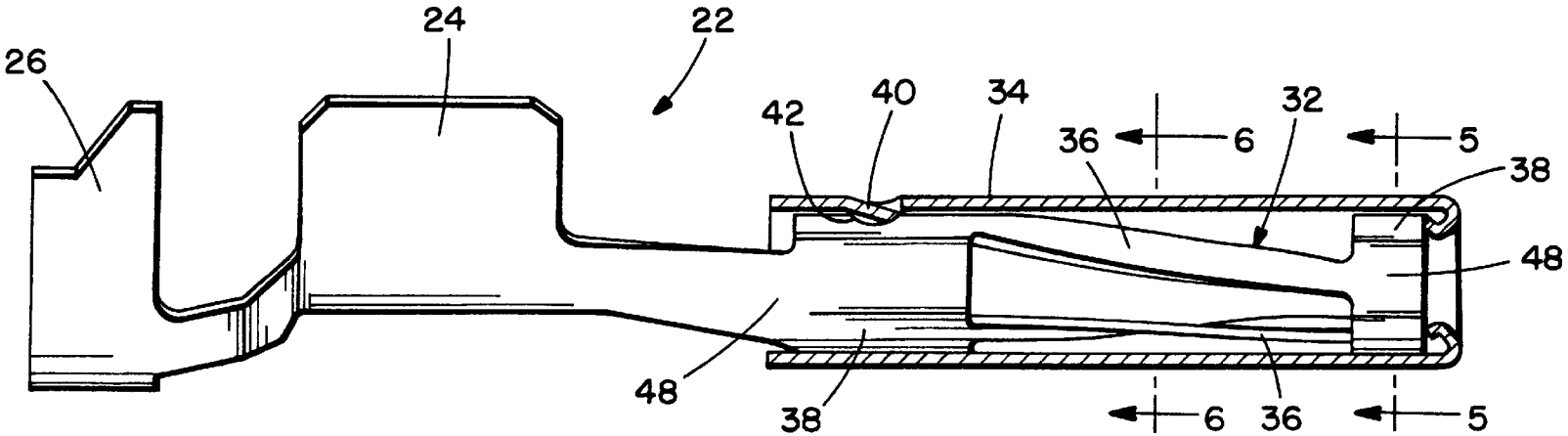
FIG. 4 is a longitudinal view with portions broken away of an assembled terminal according to FIG. 3.
Figure 5:
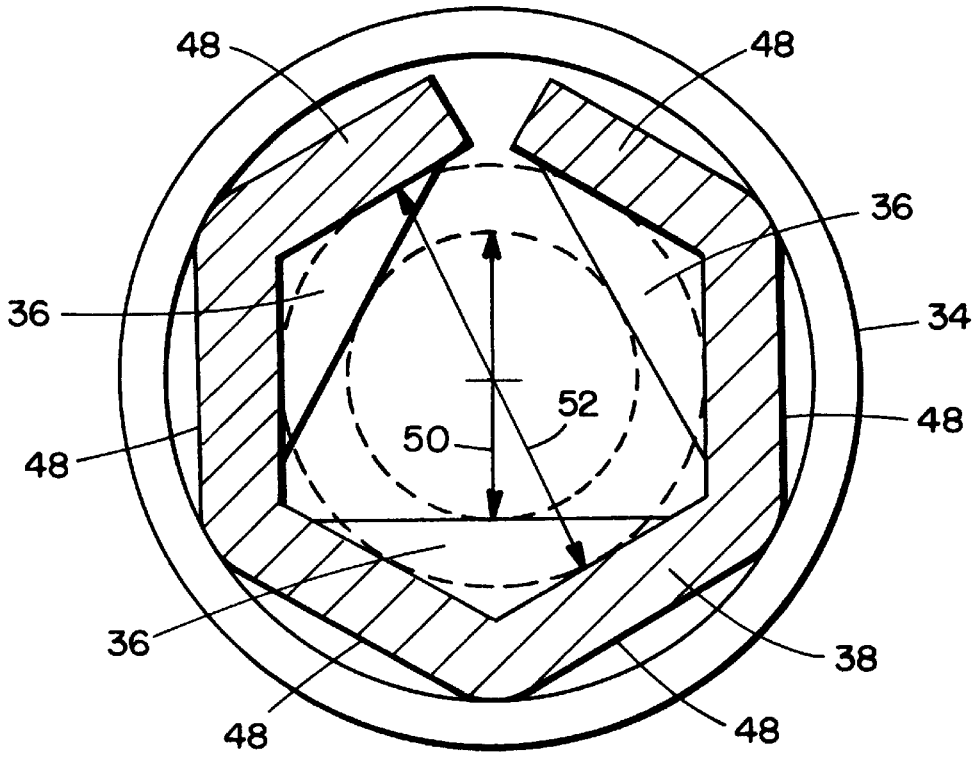
FIG. 5 is a lateral cross sectional view taken substantially along line 5—5 in FIG. 4.

According to conventional progressive die forming techniques, the stamping 44 is folded such that the end strips 46 are formed into the end ferrules 38 mentioned above which exhibit the hexagonal shape seen in FIGS. 3 and 5. The end ferrules 38 therefore can be described as a series of circumferentially oriented flats 48.

Figure 6:
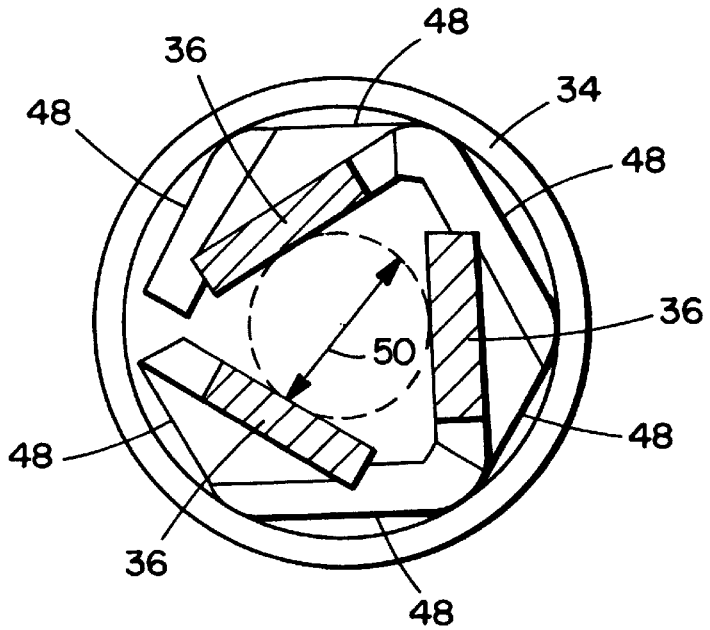
FIG. 6 is a lateral cross sectional view taken substantially along line 6—6 in FIG. 4.
Figure 7:
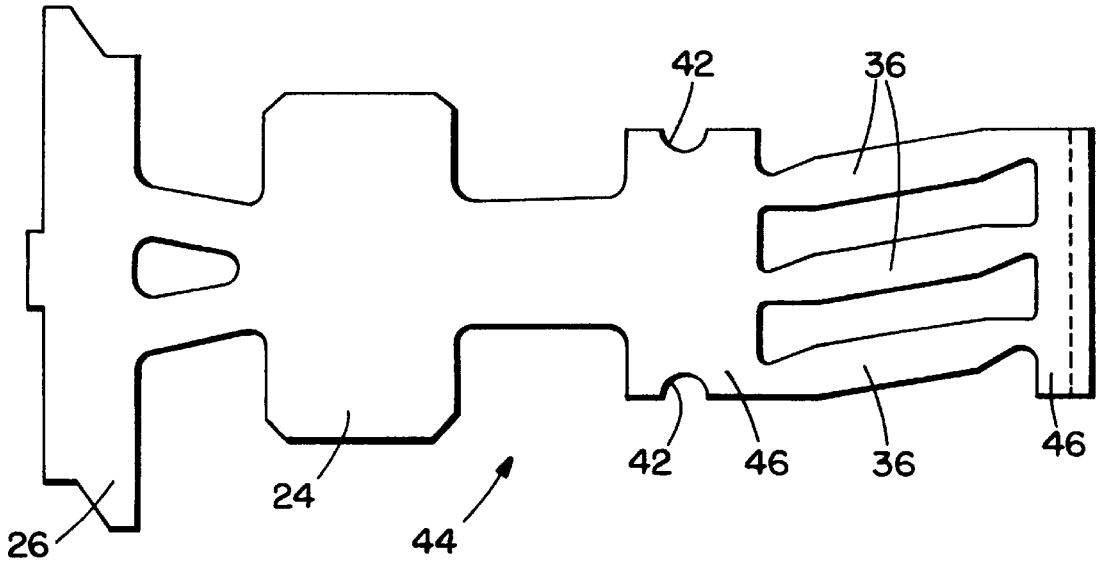
FIG. 7 is a top plan view of a stamping used for form the terminal seen in FIGS. 4–6.

Because of the orientation of the beams 36 as originally formed in the stamping 44, upon folding of the end strips 46 into the hexagonal end ferrules 38, the beams 36 will extend obliquely from a flat 48 of one end ferrule 38 to the circumferentially adjacent flat 48 on the opposing end ferrule 38. This results in the beams 36 providing the female terminal 22 with an effectively reduced diameter 50 at approximately the longitudinal center of the beams 36. As seen in FIGS. 5 and 6, the reduced diameter 50 is reduced relative to the effective diameter 52 which would otherwise be defined by the end ferrules 38.

Figure 9:
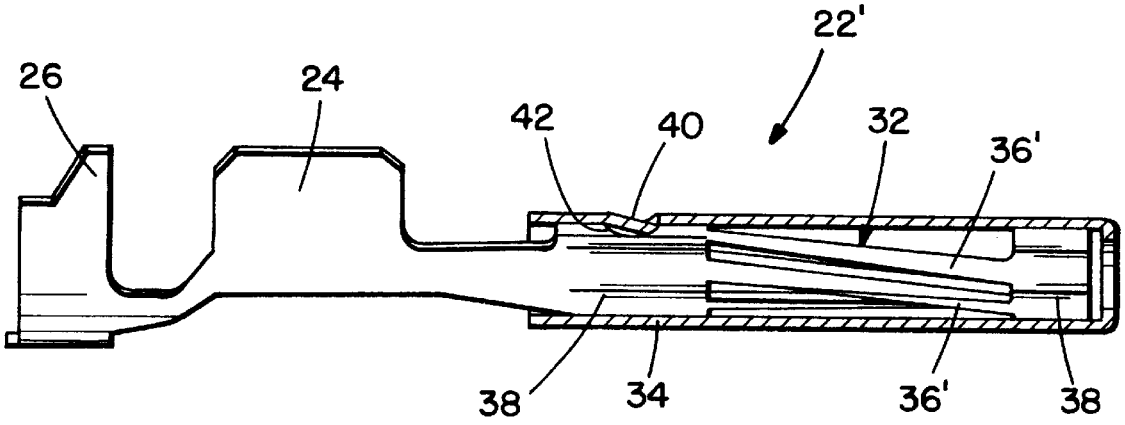
FIG. 9 is a side elevational view with portions broken away of a second embodiment of a terminal according to the principles of the present invention.

An alternative embodiment of the female terminal of the present invention is generally illustrated in FIG. 9 and designated at 22'. In this embodiment, the terminal 22' is provided with five beams 36' as opposed to the three seen the prior embodiment. The number of beams 36 can be varied depending on the required electrical performance of the terminal 22. In general, the number of beams will be one less than the number of flats to be formed in the end ferrules.

Figure 10:
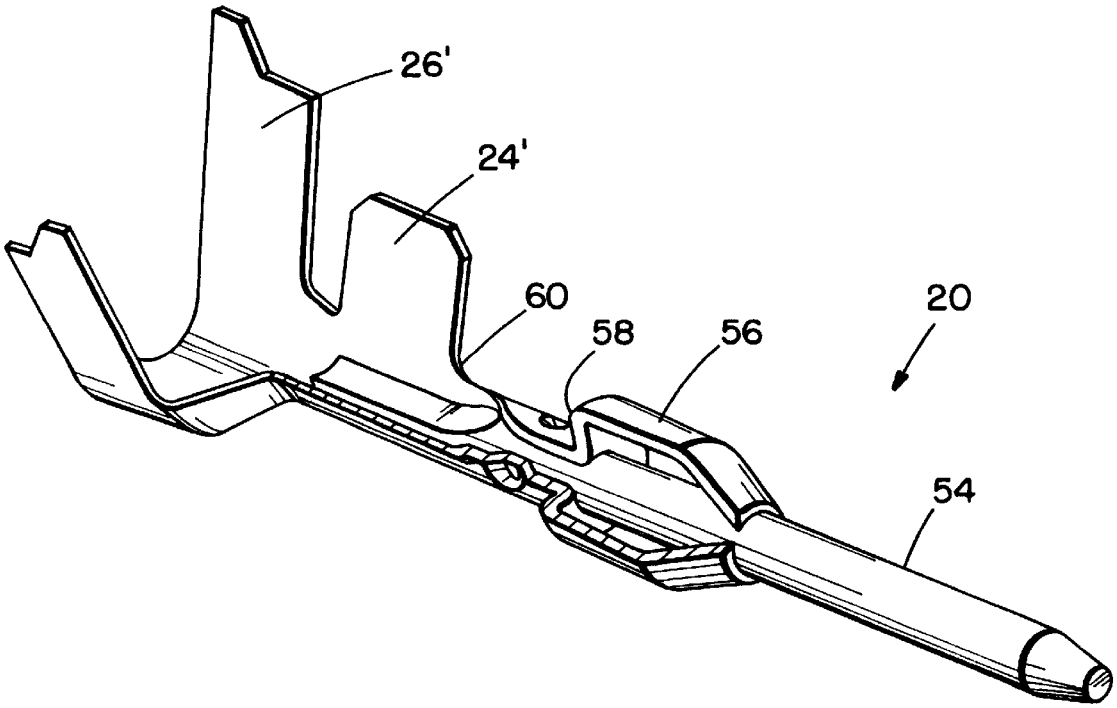
FIG. 10 is a perspective illustration with portions broken away of one embodiment of a male terminal as utilized in the present invention.

A male terminal 20 is generally illustrated in FIG. 10. Generally, a round pin 54 is formed on the distal end of the terminal 20 and adapted to engage the beams 36 of the female terminal 22. As with the female terminal 22, one end of the male terminal 20 is provided with wire and seal crimping portions 24' and 26'. Between the opposing ends of the terminal 20, an increased diameter portion 56 is formed so as to define a shoulder 58 which faces in the direction of the engaging portions 24' and 26'. As further discussed below, the shoulder 58 is utilized to prevent inadvertent disengagement of the terminal 20 from the connector body 12 or 14. While the male terminal 20 is illustrated in FIG. 10 as having a two-piece construction where the pin 54 is received and retained within a folded stamping 60 (which forms the shoulder 56 and the engaging portions 24' and 26'), alternatively, the male terminal 20 could be formed with a unitary, one-piece construction as will be readily appreciated by those skilled in the art.

The above terminal construction is beneficial for numerous reasons. First, the male terminal 20 will be supported uniformly in the female terminal 22 by identically formed beams 36. This in turn causes electrical contact to be centered with respect to a contact force equilibrium standpoint and, as a result, the electrical current transmitted through the terminals 20 and 22 will be uniformly distributed through each beam 36 eliminating the development of "hot spots" that could lead to terminal fatigue and failure. The oblique orientation of the springs 36 also causes the beams 36 to contact the male terminal 20 along a line of contact that wraps around the terminal 20. This, as opposed to the point contact which occurs in conventional parallel or perpendicular contact configurations of terminal springs, is beneficial during mating of male terminal 20 with the female terminal 22 in that it provides a shearing, cleaning action that displaces foreign material to the side of the terminal 20 and does not trap the foreign material within the electrical interface.

From a mechanical standpoint, during mating of the male terminal 20 with the female terminal 22, the present construction enables the oblique beams 36 to deflect outward twisting the male terminal 20 as it is inserted. This introduces a shearing component into the mating force diagram reducing the required insertion force relative to the spring contact force. Additionally, since each beam 36 extends from one flat 48 to a circumferentially adjacent flat 48 of the opposing end ferrule 38 of the female terminal 22, each beam 36 defines or presents a uniform leading angle to the male terminal 20, both during insertion and withdrawal. This lead-in angle and the positioning of the beams 36 is also automatically produced during formation of the female terminal 22 and does not require any additional or subsequent forming operations. In that the male terminal 20 only contacts the beams 36 of the female terminal 22, the male terminal 20 is permitted to "float" within the female terminal 22 since the beams 36 will cooperate and adjust to any imperfections in the shape of the pin 54.

From a manufacturing standpoint, the present configuration of the terminal 22 can be manufactured at high speed using standard progressive die technology. Multiple piece assemblies are not utilized nor are any of the portions of this assembly 10 required to be twisted relative to another portion of the assembly 10 in order to achieve proper positioning of the beams 36. As mentioned above, the beams 36 are automatically positioned in the terminal 22 during the formation of the terminal 22. No subsequent or special manufacturing steps are required to locate the beams 36 within the terminal 22 of this assembly 10.

Figure 2:
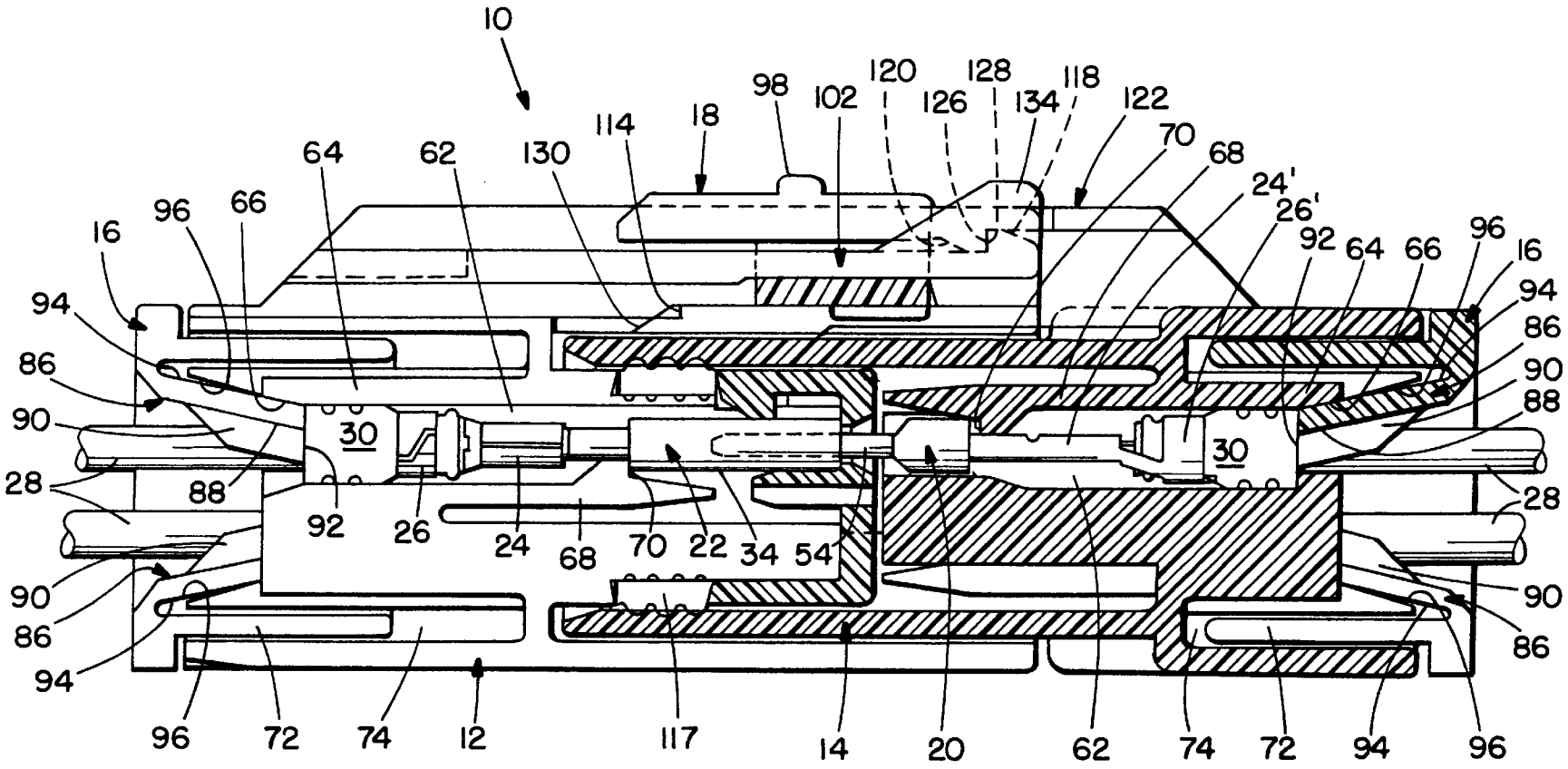
FIG. 2 is a longitudinal cross sectional view through the assembly of FIG. 1 illustrating the various features of the present invention and further showing the electrical terminals being located therein.

Referring back to FIGS. 1 and 2, it can be seen that the male and female terminals 20 and 22 are individually received with terminal cavities 62 defined within the male and female connector bodies 12 and 14. These cavities 62 (six are illustrated but more or less, as needed, may be provided) are defined by the cylindrical side walls 64 located interiorly in the connector bodies 12 and 14. To assist in the introduction of the terminals 20, 22 into the cavities 62, the cylindrical walls 64 are formed with a angled lead-in surface 66 at their outboard end. Accordingly, the lead-in surface 66 is tapered in the direction of terminal insertion.

To retain the terminals 20, 22 within the cavities 62, an inboard portion of the cylindrical wall 64 is formed with a resilient finger 68 having an inwardly directed shoulder 70 thereon. During insertion of the terminals 20, 22, the fingers 68 are biased outwardly by the terminals 20, 22 until the contact portion 32 of the female terminal 22 and the increased diameter portion 56 of the male terminal 20 pass beyond the shoulders 70. The fingers 68 are resultingly inherently biased toward the terminals 20 and 22 such that the shoulders 70 are positioned to interferingly engage the inboard end ferrule 38 of the female terminal 22 and the shoulder 58 of the increased diameter portion 56 of the male terminal 20, if withdrawal of the terminals 20 and 22 is attempted.

When received within the cavity 62, the outer diameter of the seals 30 of the terminals 20, 22 circumferentially engage the cylindrical wall 64 sealing the entrance into the cavity 62.

Figure 11:
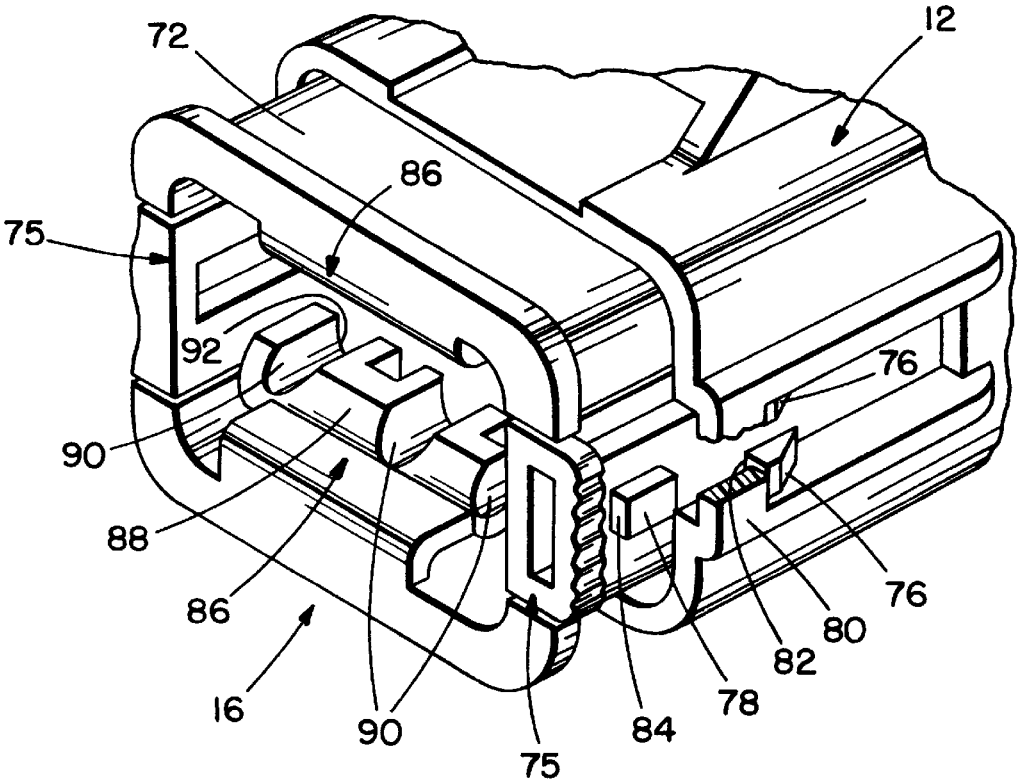
FIG. 11 is a perspective view of a TPA member according to one aspect of the present invention with the TPA member mounted to a connector body.
Figure 12:
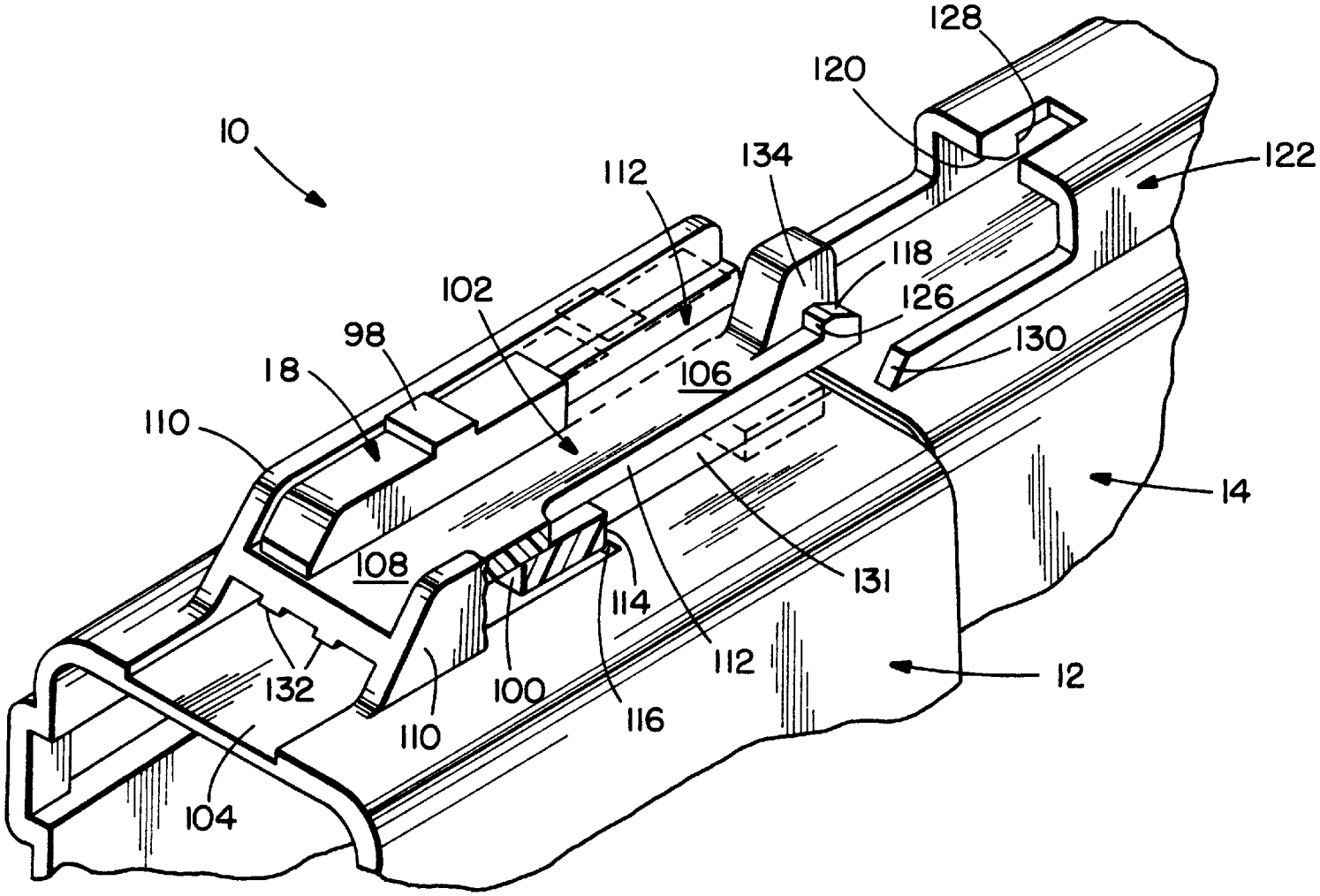
FIG. 12 is a partial perspective view of a CPA member according to another aspect of the present invention.

Mounted to the terminal insertion ends of the connector bodies 12, 14 are the TPA members 16 mentioned above. Generally, each TPA member 16 includes a peripheral wall 72 which is received within a correspondingly shaped peripheral groove 74 (seen in FIG. 2) defined in the connector body 12, 14. The two lateral sides of the peripheral wall 72 are each formed with a deflectable lock arm 75, a set of lock ramps 76 (located toward the fixed end of the lock arm 75) and a lock boss 78 (located toward the flexible end of the lock arm 75). The lock ramp 76 and lock boss 78 respectively hold the TPA member 16 in its preassembled and fully assembled positions. To retain the TPA member 16 in its preassembled position (as seen in FIG. 11) the lock ramps 76 are moved to a position where they engage a lock housing 80 formed on the corresponding sides of the connector body 12. Interaction and interference engagement between a shoulder 82 defined on the lock ramp 76 and the lock housing 80 prevent inadvertent disengagement of the TPA member 16 from the connector body 12.

With the TPA members 16 in their preassembled positions, the terminals 20, 22 are inserted into the connector bodies 12, 14. Once the terminals 20, 22 have been inserted, the operator deflects the lock arms 75 inwardly while the TPA members 16 are pushed into the connector body 12. This causes lock boss 78 to move past the lock housing 80 to a position where a shoulder 84, defined on the lock ramp 78, interferingly engages the lock housing 80 preventing withdrawal of the TPA members 18 from the connector bodies 12, 14. The lead end of the lock boss 78 is not ramped and this prevents the TPA member 18 from inadvertently being moved into its fully assembled position. In order to remove the TPA members 16 from the connector bodies 12, 14, the operator must manually flex the lock arms 75 while simultaneously pulling on the TPA members 16.

With the TPA members 16 in their preassembled positions, as seen in FIG. 11, the male and female terminals 20, 22 are inserted into the connectors 12, 14 as described above. As the terminals 20, 22 are inserted into the assembly connector bodies 12, 14, the terminals 20, 22 slide past what is herein referred to as a "stuffer" 86. The stuffers 86, which are unitary portions of the TPA members 16, do not interfere with nor need to contact the terminals 20, 22 during their insertion into the connector bodies 12, 14. The stuffers 86 are formed with the TPA members 16 so as to have a deflectable end 88 generally directed toward the interior of the connector bodies 12, 14. These deflectable ends 88 are also provided with semi-circular grooves 90 which terminate in push surfaces 92 for reasons more fully explained below. The grooves 90 are themselves located on the stuffers 86 so as to generally correspond with the cavities 62 on one side of the connector bodies 12, 14 forming extensions of the lead-in surfaces 66. Accordingly, each TPA member 16 utilizes two stuffers 86 positioned opposite one another. If desired, a greater number of stuffers 86 could be employed to achieve the desired results which are further described below.

With the terminals 20, 22 inserted into the connector bodies 12, 14, the TPA members 16 can now be moved into their fully assembled positions. During this movement, a ramped undersurface 94 on the stuffers 86 engages a ramped surface of a rib 96 which is provided as an extension off of the lead-in surface 66 of the cylindrical walls 64 mentioned above. The stuffers 86 are therefore deflected inwardly, toward the central axis of the assembly 10, locating the push surfaces 92 immediately behind the seals 30 of the terminals 20, 22. Continued insertion of the TPA members 16 into the connector bodies 12, 14 further causes the stuffers 86 to be biased inward by the ramped surfaces of the ribs 96 until the push surfaces 92 engage the rearwardmost surfaces of the seals 30 and causing the stuffers 86 to drive the seals 30 and terminals 20, 22 forward into their fully seated positions within the connector bodies 12, 14. The relative length and positioning of the various features discussed above are such that when the terminals 20, 22 become fully seated within the assembly 10, the TPA members 16 will have been moved into their fully assembled positions where they are retained by the lock arm 75 and lock housing 80. If an obstruction is formed in one of the cavities 62, the affected TPA member 16 will not be permitted to move into its fully assembled position. In the above manner, the TPA members 16 assure that the terminals 20, 22 have been properly positioned within the assembly 10.

Referring now to FIGS. 12–15, the connector position assurance feature of the present invention will be described in greater detail. As mentioned previously, the CPA member 18 is generally a sliding member which is preassembled onto the female connector body 12. More specifically, the CPA member 18 itself includes two upwardly extending actuator portions 98 and a lower interconnecting portion 100 which extends between and transversely interconnects the actuator portions 98. The CPA member 18 is retained with the female connector body 12 by interaction with a deflectable lock arm 102 that is unitarily formed with an upper wall 104 of the connector body 12. The lock arm 102 itself includes a deflectable end 106 and a fixed end 108 with the fixed end being connected through upstanding walls 110 to the top wall 104 of the female connector body 12. Since the upstanding walls 110 extend substantially the length of the top wall 104, the deflectable end 106 of lock arm 102 is defined and separated from the upstanding walls 110 by a pair of parallel lateral slots, generally designated at 112.

Initial mounting of the CPA member 18 results in the CPA member 18 being located with its actuator portions 98 above the deflectable arm 102 and its interconnecting portion 100 extending beneath the lock arm 102. The actuator portions 98 have a width which prevents them from passing vertically through the slots 112. They therefore slide on the top of the lock arm 102. When the CPA member 18 has been slid fully rearward, toward the fixed end 108 of the lock arm 102 and toward the terminal insertion end of the connector body 12, the interconnecting portion 100 drops into a cut-out 116 while a forward facing shoulder 114 defined on the interconnecting portion 100 engages a rearward face of the cut-out 116 (which is formed in the top wall 104 of the connector body 12). This is the preassembled position of the CPA member 16 and it is retained as a result of the inherent resiliency of the lock arm 102 which urges engagement between the shoulder 114 and the cut-out 116.

As the male and female connectors 14, 12 are engaged with one another, a seal 117 ensures that the terminal cavities are isolated from ambient conditions. During this engagement, the lock arm 102 is initially deflected toward the female connector body 12 as a pair of ramps 118 on the deflectable end 106 of the lock arm 102 engage correspondingly opposing ramps 120 formed on the underside of a lock housing 122. The lock housing 122 is formed as a part of the top wall 104 of the male connector body 14. This further results in the CPA member 18 being retained in the preassembled position. If any attempt is made to move the CPA member 18 out its preassembled position at this point, the result will only be an increased engagement force being applied between the connector bodies 12, 14. Once the male and female connector bodies 14, 12 have been fully engaged with one another, the ramped surfaces 114, 116 will have moved axially past one another and the resilient nature of lock arm 102 will bias the deflectable end 106 of the lock arm 102, outward allowing a shoulder 126 formed adjacent to the ramp 118 to engage a corresponding shoulder 128 adjacent to ramp 120.

Only after complete and full engagement of the connector bodies 12, 14 is it possible for the CPA member 18 to be moved out of its preassembled position. Such movement is further described below.

Figure 14:
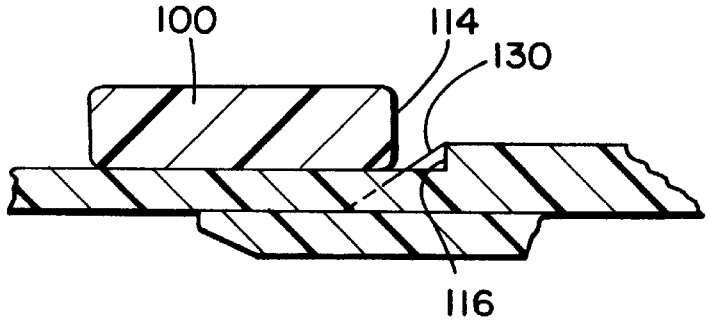

Movement of the CPA member 18 after full engagement of the connectors 12, 14 is enabled by a pair of release ramps 130. The release ramps 130 are extensions off of the lock housing 122 and are located so that they will extend into a recess 131 defined in the top wall 104 of the female connector 12 when the connectors 12, 14 are engaged. The release ramps 130 are positioned on the male connector 14 such that the ramps 130 will be located beyond the cut-out 116 formed in the top wall 104 when the connectors 12, 14 are fully engaged. This is shown in FIG. 14. When so positioned, the ramps 130 enable the interconnecting portion 100 to be slid up the ramps 130 and over the cut-out 116. Further sliding of the CPA member 18 in the direction of engagement of the connectors 12, 14 results in the interconnecting portion 100 being positioned beneath the deflectable end 106 of the lock arm 102 where it becomes wedged and prevents the lock arm 102 from deflecting and allowing disengagement of the connectors 12, 14 from one another.

Figure 13:
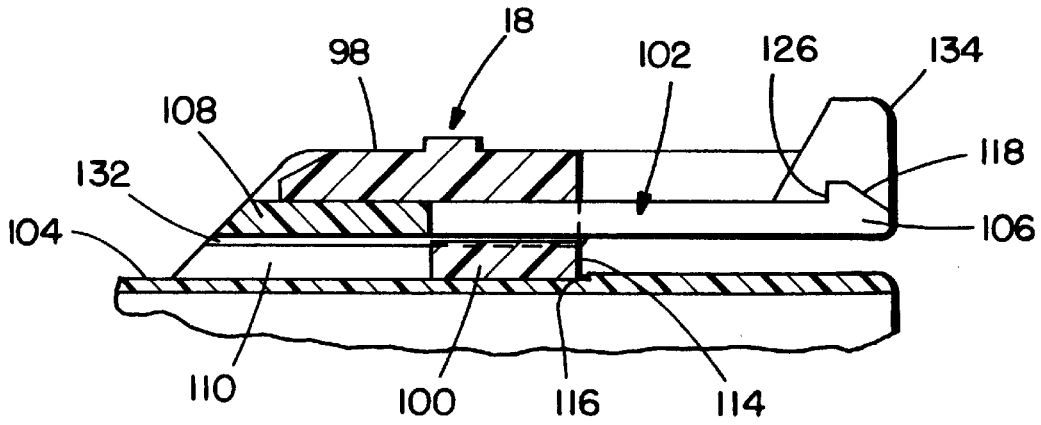
FIGS. 13–15 are partial sectional views of the CPA member and connector bodies seen in FIG. 12 showing the movement of the CPA member from its preassembled position into its fully assembled position.
Figure 15:
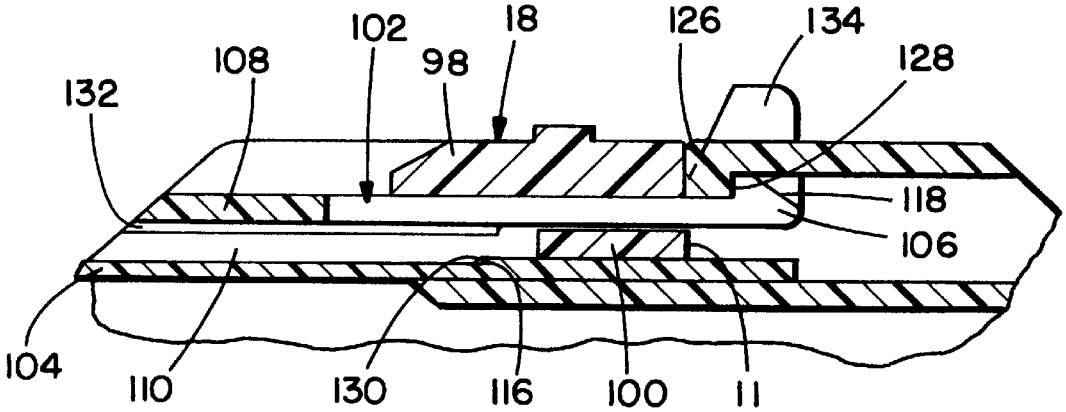

A pair of ribs 132 are provided on the underside of the lock arm 112 to further aid in retaining the CPA member 18 in its preassembled and fully assembled positions. As seen in FIGS. 13 and 15, the ribs 132 terminate generally above the cut-out 116. By providing these ribs 132, an operator must supply a predetermined amount of force to move the interconnecting portion of the CPA member 18 up the release ramps 130 and overcome the forces imposed by the ribs 132. Accordingly, the CPA member 18 is prevented from being inadvertently moved into the connector assured or fully engaged position. As the CPA member 18 disengages from the ribs 132, the operator is given tactile indication by the CPA member 18 that proper engagement of the connectors 12,14 has occurred.

From the above, it can be seen that the CPA member 18 of the present invention has numerous advantages. One major advantage of this design is that once the connector mating process has begun, forceful pressing on the CPA member 18 will only transmit forces to the connector in the form of a mating force. It is only after the connectors 12 and 14 have been fully mated is it possible for the CPA member 18 to move into its final assembled position thereby indicating full engagement. In this manner, the CPA member 18 assures that the connectors are in their proper position. Another advantage of the present CPA member 18 design is that the CPA member 18 is prevented from being inadvertently knocked off the connector 12 and lost. This is achieved by the ribs 132 mentioned above in conjunction with the cut-out 116. Another advantage is provided by an upstanding rib 134 located on the deflectable end 106 of the lock arm 102. This upstanding rib 134 is provided as a push rib for disengaging the connectors 12,14 from one another. To disengage the connectors 12, 14, the CPA member 18 is moved rearwardly and a downward and rearward force is applied to the upstanding rib 134 to disengage the shoulders 126 and 128 and separate the connectors 12 and 14. The forward movement of the CPA member 18 up the release ramps 130 of the lock housing 122 also results in several advantages. For example, the upward movement of the connecting portion 100 results in the free end 106 of the lock arm being biased upward and further locking the shoulders 126 and 128 in engagement with one another.

While the above description constitutes the preferred embodiment of the present invention, it will be appreciated that the invention is susceptible to modification, variation and change without departing from the proper scope and fair meaning of the accompanying claims.

It is claimed:

1. A socket type female electrical terminal comprising a one piece body formed of a flat sheet metal stamping which has been folded to define a wire attaching portion and a contact portion for receiving a male terminal therein, said contact portion having a generally cylindrical shape with opposing ends defined by two generally annular cross-sectional polygon shaped ferrule portions including a front ferrule portion and a rear ferrule portion, said ferrule portions defining a first effective diameter therein, said flat sheet metal stamping comprising a plurality of contact beans extending between said ferrule portions at a slanted angle relative to a longitudinal axis of the terminal, wherein when said sheet metal stamping is folded said contact beams extend between said ferrule portions so as to define a second effective diameter located between said ferrule portions, said second effective diameter being less than said first effective diameter, said terminal further comprising a hood retainingly engaged over said contact portion and retained thereto generally at said rear ferrule portion.

2. An electrical terminal as set forth in claim 1 wherein said beams extend diagonally between said ferrule portions.

3. An electrical terminal as set forth in claim 1 having three beams.

4. An electrical terminal as set forth in claim 1 having five beams.

5. An electrical terminal as set forth in claim 1 wherein said beams include preload means for inducing a preload into said beams.

6. An electrical terminal as set forth in claim 1 further comprising a seal engaging portion for retaining a sealing member with said terminal.

7. An electrical terminal as set forth in claim 1 wherein said ferrule portions are defined by a series of circumferentially adjacent flats.

8. An electrical terminal as set forth in claim 7 wherein said beams extend from a flat of one of said ferrules to a circumferentially adjacent flat of the other of said ferrule portions.

9. An electrical terminal as set forth in claim 7 wherein said ferrule portions are hexagonal in shape.

10. An electrical terminal as set forth in claim 7 wherein said beams number one less than the number of said flats on one of said ferrules.

11. A socket type female electrical terminal comprising: a one piece body formed of a folded flat sheet metal stamping to define a wire attaching portion and a contact portion for receiving a male terminal therein, said contact portion having a generally cylindrical shape with opposing ends defined by generally annular front and rear ferrule portions, said ferrule portions being defined by a series of circumferentially adjacent flats generally defining a first effective diameter therein, said flat sheet metal stamping comprising a plurality of contact beams extending between said ferrule portions at a slanted angle relative to a longitudinal axis of the terminal, wherein when said sheet metal stamping is folded said contact beams; extend diagonally between said ferrule portions from a flat of one of said ferrule portions to a circumferentially offset flat of the other of said ferrule portions so as to define a second effective diameter located between said ferrule portions, said second effective diameter being less than said first effective diameter.

12. An electrical terminal as set forth in claim 11 further comprising a hood surrounding said ferrule portions and said beams, said hood being secured to said terminal generally at said rear ferrule portion.

13. A socket-type female electrical terminal comprising:

a one-piece, unitarily formed sheet metal body including a wire attaching portion and a contact engaging portion, said wire attaching portion including means for securing a wire thereto, said contact engaging portion being configured to receive and engage a male terminal inserted therein, said contact engaging portion including a front ferrule portion and a rear ferrule portion, said rear ferrule portion being adjacent to said wire attaching portion, said front and rear ferrule portions each having a discontinuous, generally annular shape formed from a series of circumferentially oriented flats and defining a first effective diameter, said sheet metal body comprising a plurality of contact beams extending between said front and rear ferrule portions at a diagonal relative to a longitudinal axis of the terminal before said sheet metal body is folded, wherein after said sheet metal body is folded said contact beams extend diagonally between non-axially opposing portions of said front and rear ferrule portions, said contact beams cooperating to define a second effective diameter at a location between said front and rear ferrule portions, said second effective diameter being less than said first effective diameter, wherein said front and rear ferrule portions are folded by progressive die forming.

* * * * *